US006981571B2

(12) United States Patent
Diggle

(10) Patent No.: US 6,981,571 B2
(45) Date of Patent: Jan. 3, 2006

(54) CLIMBER CATCHER

(76) Inventor: Frederick James Diggle, 2054-H Vestavia Park Ct., Birmingham, AL (US) 35216

( * ) Notice: Subject to any disclaimer, the term of this patent is extended or adjusted under 35 U.S.C. 154(b) by 338 days.

(21) Appl. No.: 10/652,127

(22) Filed: Aug. 30, 2003

(65) Prior Publication Data

US 2005/0247521 A1 Nov. 10, 2005

(51) Int. Cl.
*A47L 3/04* (2006.01)
*A63B 29/02* (2006.01)
*A63B 27/00* (2006.01)

(52) U.S. Cl. ..... 182/9; 182/133

(58) Field of Classification Search ..... 182/133, 182/9, 3, 134, 93; 248/499, 500, 510, 219.1; 24/4, 3.1, 305, 307, 316, 326, 335, 369
See application file for complete search history.

(56) References Cited

U.S. PATENT DOCUMENTS 2,381,114 A * 8/1945 Cox ..... 182/9
2,842,300 A 7/1958 Johnson
2,879,830 A 3/1959 Johnson
2,920,714 A 1/1960 Johnson
3,743,050 A * 7/1973 Danz ..... 182/9
3,776,498 A * 12/1973 Peters et al. ..... 248/219.1
4,263,983 A * 4/1981 Norton ..... 182/93
4,407,391 A 10/1983 Greenway et al.
4,427,092 A 1/1984 Tentler
4,527,660 A 7/1985 Andruchiw
4,595,078 A 6/1986 Greenway
4,923,048 A * 5/1990 Cole ..... 182/9
4,991,689 A * 2/1991 Cole ..... 182/3
5,050,704 A * 9/1991 Olsson ..... 182/9
5,052,514 A * 10/1991 Rezmer ..... 182/9
5,257,677 A 11/1993 Stepp
5,341,896 A * 8/1994 Amacker ..... 182/133
6,016,891 A 1/2000 Sava
6,206,138 B1 3/2001 Yerger
6,241,045 B1 6/2001 Reeve et al.

* cited by examiner

*Primary Examiner*—Hugh B. Thompson, II

(57) ABSTRACT

An apparatus and methods of use for a climber catcher safety device having the ability to securely engage the pole so that the safety device can hold or otherwise support a body belt attached to the fallen technician. In various embodiments, the safety device includes a flexible, elongated body comprising a first end and a second end, positioning mechanism attached at the first end, and engagement mechanism attached at the second end.

3 Claims, 10 Drawing Sheets

CLIMBER CATCHER

NOTICE OF COPYRIGHT PROTECTION

A portion of the disclosure of this patent document and its figures contain material subject to copyright protection. The copyright owner has no objection to the facsimile reproduction by anyone of the patent document or the patent disclosure, but otherwise reserves all copyrights whatsoever.

BACKGROUND OF THE INVENTION

1. Field of the Invention

This invention relates generally to safety devices and methods for use by a technician and other person of similar occupation when climbing a pole, such as poles carrying telephone lines or electrical power lines.

2. Description of the Related Art

In the telecommunications or electronics industry, it is common practice for a technician (also referred to as a "linesman") to climb a pole to install equipment, to repair broken or damaged communications equipment, to test equipment, and/or other work-related reasons. In order to safely and effectively climb a pole and perform line work, the technician must maintain and properly utilize various types of climbing equipment. To utilize the various types of climbing equipment, the technician must also have the skills and the physical ability to sustain a great strain on their legs and back while the technician climbs and/or maintains a position about the pole.

Conventional climbing equipment employed by a technician typically includes a pair of gaffs, a body belt, and/or a safety strap. In general, the gaff is a sharp blade protruding from the inside of the foot about mid-foot level and having straps that secure about the leg and/or feet of a technician. To climb, the technician drives one of the gaffs into the pole, steps up onto the gaff, and then drives the other gaff into the pole at a higher position. The technician continues taking steps up or "gaffs up" the pole until reaching a desired height.

The body belt is secured around the waist of the technician. The body belt includes pockets for carrying tools and rings (e.g., "D-rings") for attaching the safety strap. The safety strap typically includes a hook (e.g., snap buckle) at each end and a buckle for adjusting its length. During climbing, both hooks of the safety strap are attached to the same ring of the body belt on the left hip. Once in a position to perform line work, the technician releases one end of the safety strap from the body belt and wraps the safety strap around the pole. The technician then reattaches the end of the safety strap to the right D-ring on the body belt, thus allowing the technician to use his hands at the desired working elevation. Thus, the technician uses the safety strap for climbing as well as supporting the technician in his working position about the pole.

During elevated line work, both gaffs are pressed into the pole and the technician leans back against the safety strap. This position allows the weight of the technician to be supported by the gaffs and the tension in the safety strap. An error in technique or defect in equipment, however, may result in serious injury to the technician. For example, there are times when a gaff dislodges or "cuts out" from the pole. If one or both of the gaffs cuts out, the technician may (i) fall straight down from atop the pole, (ii) rotate downward and fall on the head, (iii) get one or more gaffs back into the pole, and (iv) may reach out to grab/hug the pole. In many of these scenarios, the technician may, and often does, sustain injury such as to the knees, back, and/or arms.

Safety devices have been proposed for supporting the weight of the technician to prevent accidents as described above; however, the usefulness of such safety devices depends upon the willingness of the technician to use them which in turn relies upon whether such devices are conveniently and easily used in the field. As an alternative to climbing the pole, some technicians resort to using ladders or bucket trucks to perform elevated line work so as to avoid the risk of injury from a fall. This solution requires the purchase and maintenance of additional equipment and, thus, results in increased expenses for the technician's employer. In addition, work related injuries still occur when using and transporting a ladder of the size necessary to reach the top of a pole.

SUMMARY OF THE INVENTION

This invention addresses the above-described needs, and other needs, by providing a portable safety device that is capable of catching and supporting a technician (i.e., the climber) who has fallen from a columnar member, such as a pole, a tree trunk, wall, rock face, or any other columnar/vertical member. The safety device of this invention, therefore, provides added security and safety when scaling and when working atop the columnar member.

According to an embodiment, a climber catcher safety device includes a flexible, elongated body comprising a first end and a second end, positioning means attached at the first end, and engagement means attached at the second end. The flexible, elongated body extends about a circumference of the columnar member and the positioning means attaches at the first end to position and secure a portion of the flexible, elongated body about a variety of circumferences of the columnar member—that is, the climber catcher can easily be positioned about a portion of the circumference of many different sized columnar members. Further, the engagement means engages or otherwise secures to a body belt of the technician.

In various embodiments, the flexible, elongated body may be made of a chain link, a knotted rope, and/or a braided rope. According to each of these embodiments, compatible positioning cinchers are used to position and secure the flexible, elongated body about the columnar member. Another embodiment includes a locking, clip-like engagement member attached at the second end to engage a body belt of the technician.

This invention further includes a method for ascending a columnar member to a desired working elevation and/or positioning the climber catcher safety device described in the above and other embodiments so that the safety device engages the columnar member and is capable of supporting a suspended weight of the technician.

BRIEF DESCRIPTION OF THE DRAWINGS

The above and other embodiments, objects, uses, advantages, and novel features of this invention are more clearly understood by reference to the following description taken in connection with the accompanying figures, in which.

DETAILED DESCRIPTION OF THE INVENTION

This invention now will be described more fully hereinafter with reference to the accompanying drawings, in which exemplary embodiments are shown. This invention may, however, be embodied in many different forms and should not be construed as limited to the embodiments set forth herein; rather, these embodiments are provided so that this disclosure will be thorough and complete, and will fully convey the scope of the invention to those of ordinary skill in the art. Moreover, all statements herein reciting embodiments of the invention, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure). Thus, for example, it will be appreciated by those skilled in the art that the schematics and the like represent conceptual views of illustrative structures embodying this invention.

In the claims hereof any element expressed as a means for performing a specified function is intended to encompass any way of performing that function including, for example, a combination of elements that performs that function. The invention as defined by such claims resides in the fact that the functionalities provided by the various recited means are combined and brought together in the manner that the claims call for. Applicant thus regards any means that can provide those functionalities as equivalent as those shown herein.

Figure 1:
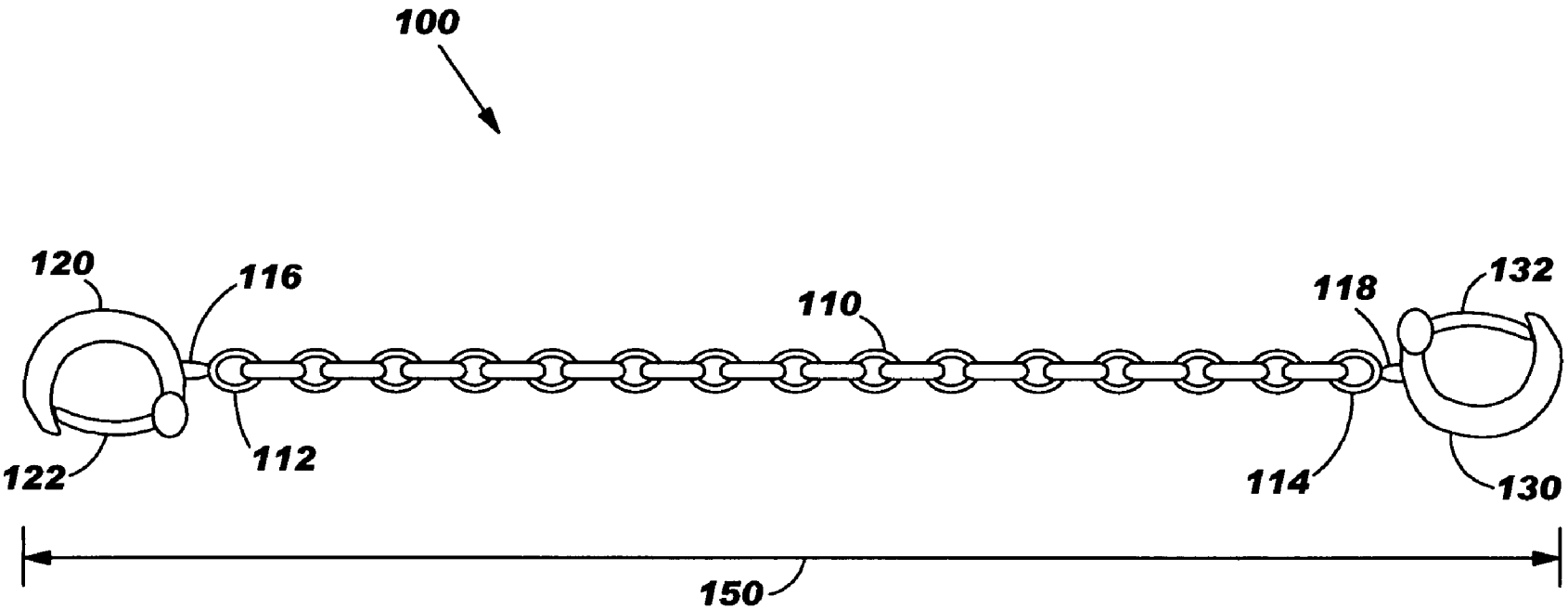
FIG. 1 is a perspective side view of a climber catcher safety device according to an embodiment of this invention.

Referring to FIG. 1, a climber catcher safety device 100 includes a flexible, elongated body of a chained link 110 having a first end 112 and a second end 114. The first end 112 is attached at joint 116 to a positioning means. The positioning means is shown as a D-shaped ring 120 having a latch 122 for engaging one of the chain links 111 of the flexible, elongated body 110. The second end 114 is attached at joint 118 to an engagement means. The engagement means is shown as a second D-shaped ring 130 having a locking latch 132 for engaging a body belt (shown as reference numeral 622 in FIG. 6) of a technician (shown as reference numeral 610 in FIG. 6). A portion of the chained link 110 may be positioned and secured about a variety of circumferences of a columnar member, such as a pole, a tree trunk, wall, rock face, or any other columnar/vertical member by wrapping the chained link 110 about the columnar member and fixing the D-ring 120 about the desired link such that the wrapped portion of the chained link 110 frictionally engages the columnar member. According to an embodiment of this invention, a length 150 of the chained link 110 is approximately five feet (approximately sixty inches). Alternatively, as one of ordinary skill in the art appreciates, this measurement may vary so long as the climber catcher safety device 100 supports the weight of a fallen technician as herein described. In addition, the climber catcher safety device 100 may be manufactured using any appropriate material that can support the weight of a technician, tools, and other gear (as well as any safety factor that accounts for stress loading, such as the force of a fall) and also withstand a wide range of temperatures, humidity, moisture, and other environmental conditions. For example, the climber catcher safety device 100 can be formed of steel, titanium, aluminum, and other metals. The climber catcher safety device 100 may also have a durable finish coating, such as polyurethane powder. Alternatively, the climber catcher safety device 100 could be constructed of other metals, polymer, plastic, composite, ceramic, glass, crystal, and/or other appropriate materials and combinations that are capable of being used as herein described. The safety device 100 could additionally or alternatively have a sacrificial coating for corrosion resistance.

Figure 2:
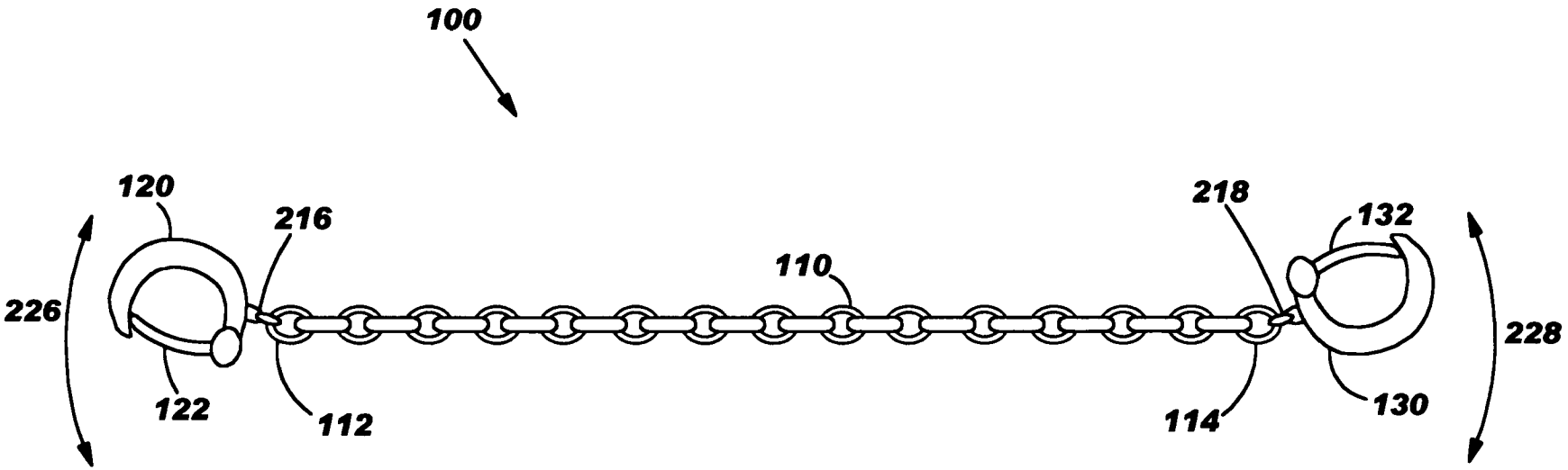
FIG. 2 is a perspective side view of a climber catcher safety according to another embodiment of this invention.
Figure 3:
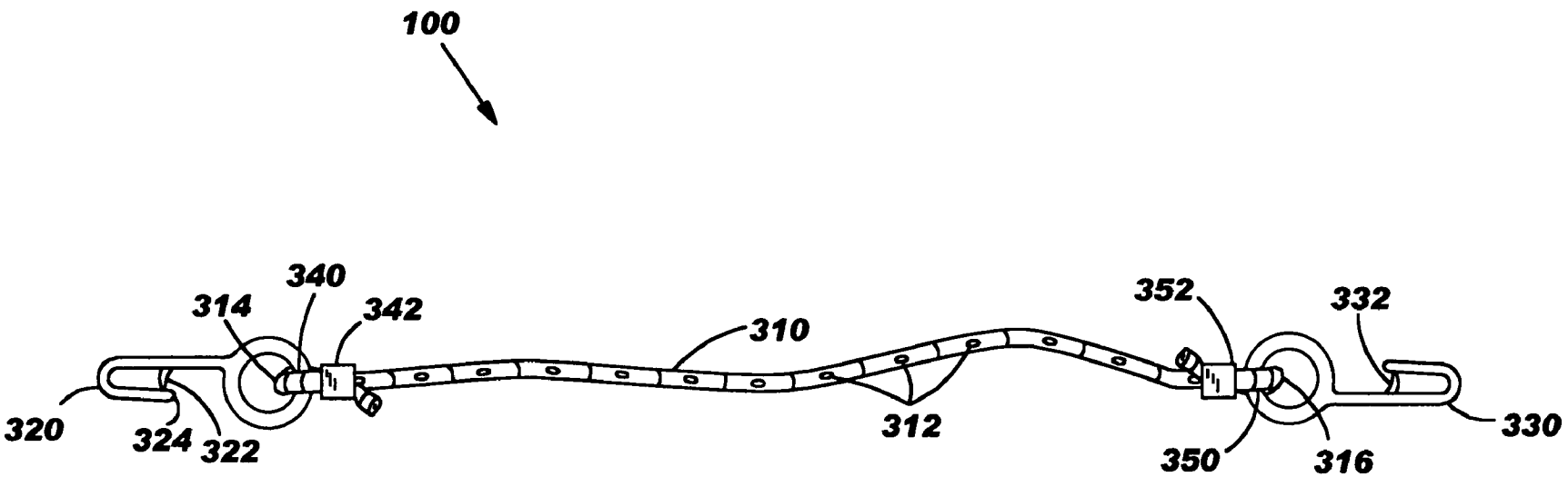
FIG. 3 is a perspective side view of another climber catcher safety according to an embodiment of this invention.

As depicted in FIG. 1, the flexible, elongated support body is a chained link 110 with positioning means (i.e., the D-shaped ring 120 having a latch 122) at the first end 112 to position and secure the climber catcher safety device 100 about the columnar member. As one of ordinary skill in the art appreciates, however, the flexible, elongated support body, the positioning means, and the engagement means may comprise a variety of configurations and materials. For example, FIG. 2 shows a climber catcher safety device 100 similar to FIG. 1; however, the first end 112 has a flexible joint 216 attached to the D-ring 120 that allows the positioning means to move in a direction of line 226. The second end 114, similarly, has another flexible joint 218 attached to the second D-ring 130 that allows the engagement means to move in a direction of line 228. Each of the D-rings (or alternate positioning means and engagement means) 120, 130 can be swiveled into a desired position for easily mating with the desired link or with the body belt. FIG. 3 shows the flexible, elongated support body 100 as a braided cable 310 having holes 312 along a central portion of the braided cable 310. A first end 314 includes a first loop 340 about a U-shaped cincher 320 having a hook 324 that fits through one of the holes 312 and a spring-loaded latch 322 that locks the U-shaped cincher 320 about the selected hole 312. The loop 340 of the first end 314 is bound by a clamp 342. A second end 316 includes a second loop 350 about a D-shaped, locking ring 330 with a second spring-loaded latch 332. The loop 350 of the second end 316 is bound by a clamp 352.

Figure 5:
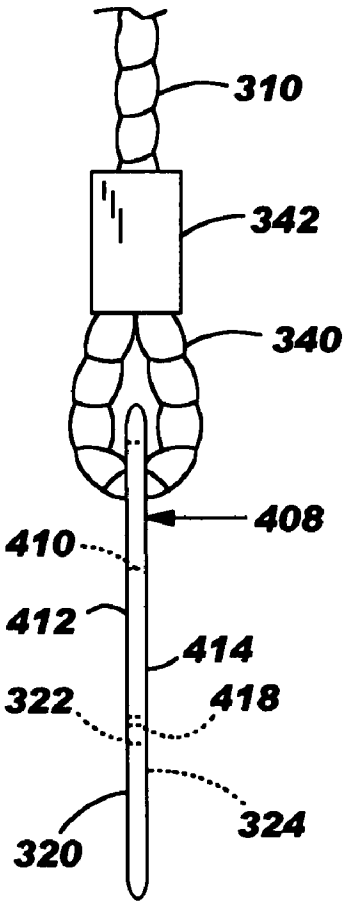
FIG. 5 is a perspective top view of the cincher of FIG. 5 according to an embodiment of this invention.
Figure 4:
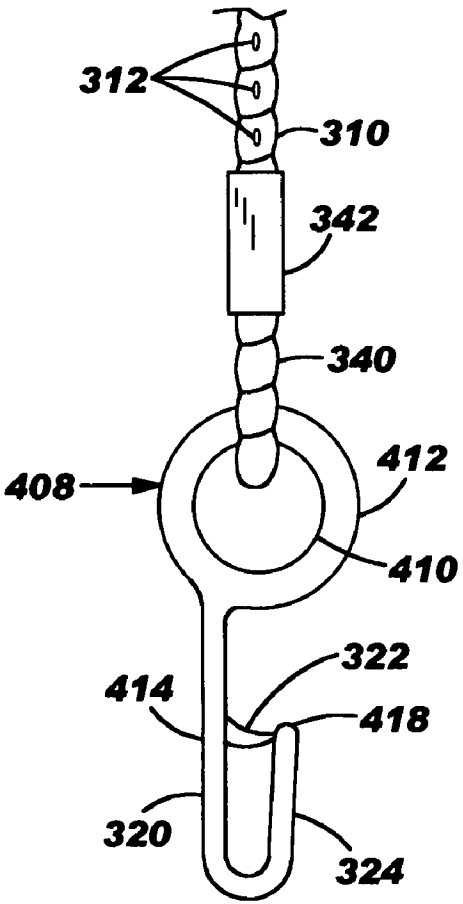
FIG. 4 is a perspective side view of a cincher attached to a first end of the climber catcher of FIG. 3 according to an embodiment of this invention.

FIGS. 4 and 5 show more detailed views of the U-shaped cincher 320 shown in FIG. 3. The U-shaped cincher 320 attaches to the loop 340 of the first end 314. The U-shaped cincher 320 includes a ring 408 having an inner surface 410. The first end 314 loops through the ring 408. The ring 408 has an outer surface 412 that includes an outwardly extending arm 414 with the hook 324 at an end of the arm 414. The hook 324 is sized so that a tip 418 can penetrate the selected hole 312. The latch 322 closes behind the hole 312 and fixes the safety device 100 to a desired circumference such that the safety device 100 frictionally engages the columnar member. A similar cincher (not shown) may be used at the second end 316 to engage a body belt of the technician. The U-shaped cincher 320 is preferably stamped or pressed from metal material as an integral, single piece device. The U-shaped cincher 320 may alternatively be welded or cast from metal material. The metal material may have any composition, any cold/heat treatment, or any quenching. The metal material may have any rust inhibitor and/or sacrificial coating to reduce corrosion. The U-shaped cincher 320 could alternatively be formed from composite material(s), polymer material(s), and other appropriate materials if the application warrants. As one of ordinary skill in the art appreciates, the U-shaped cincher 320 may take on a variety of shapes such as V-shaped, D-shaped, and others so long as the cincher 320 is designed to fix the flexible, elongated body, such as the braided cable 310, into a desired position about the columnar member.

Figure 6:
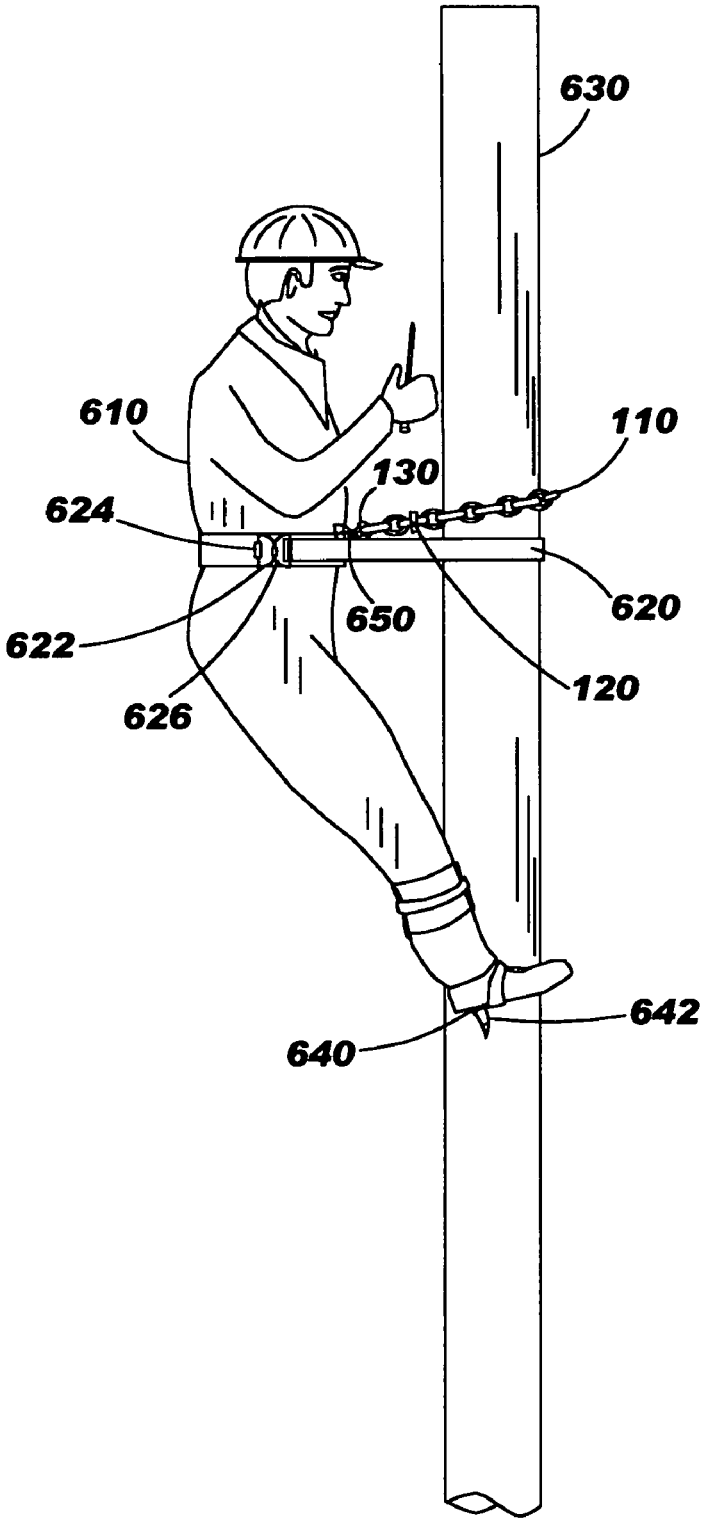
FIG. 6 illustrates a perspective side view of an elevated, secured technician with the climber catcher safety device of FIG. 1 positioned above and proximate to a safety strap secured to the technician according to an embodiment of this invention.
Figure 7:
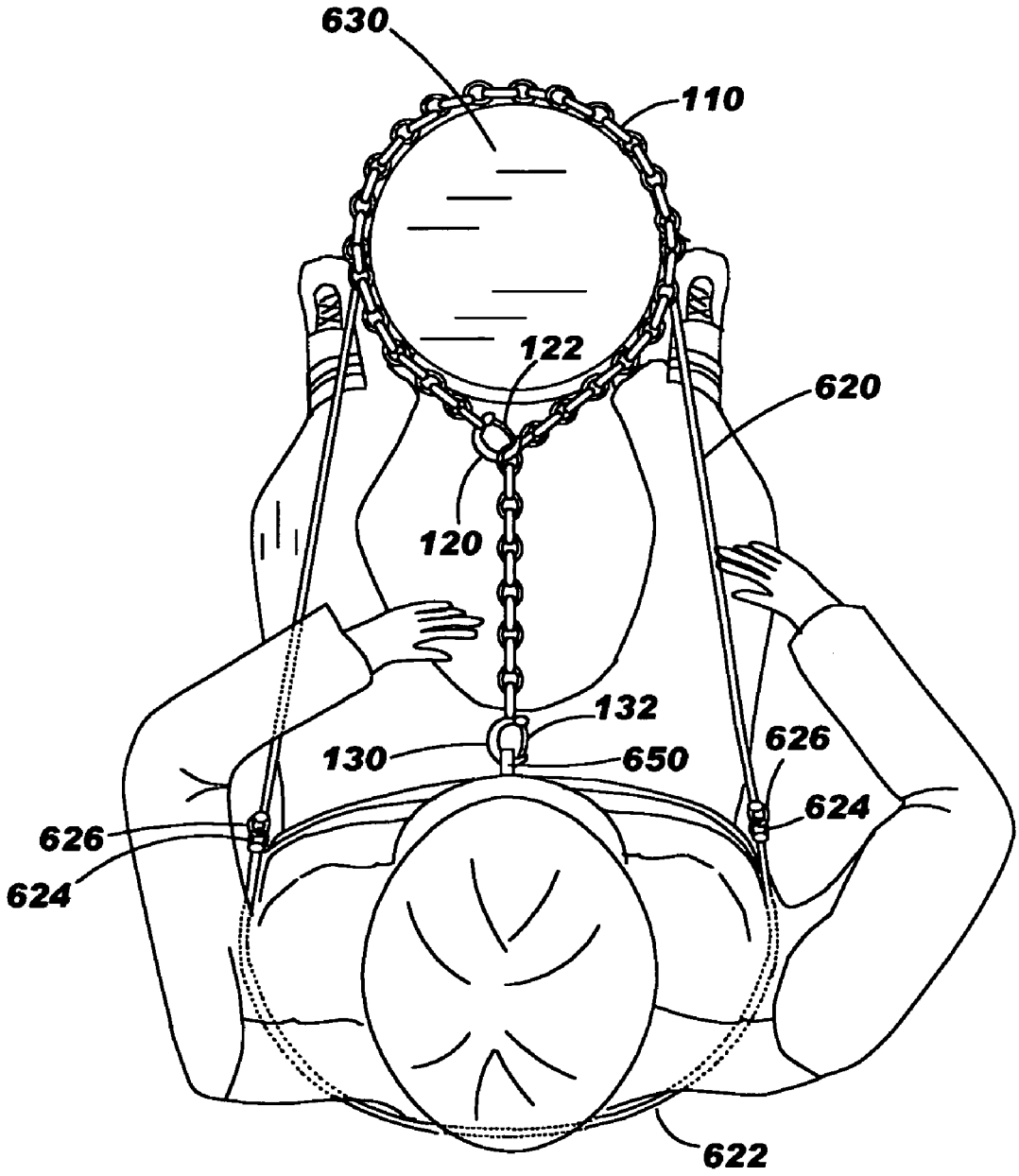
FIG. 7 illustrates a perspective top view of the elevated, secured technician with the climber catcher safety device of FIG. 1 positioned above and proximate to the safety strap secured to the technician according to an embodiment of this invention.
Figure 8:
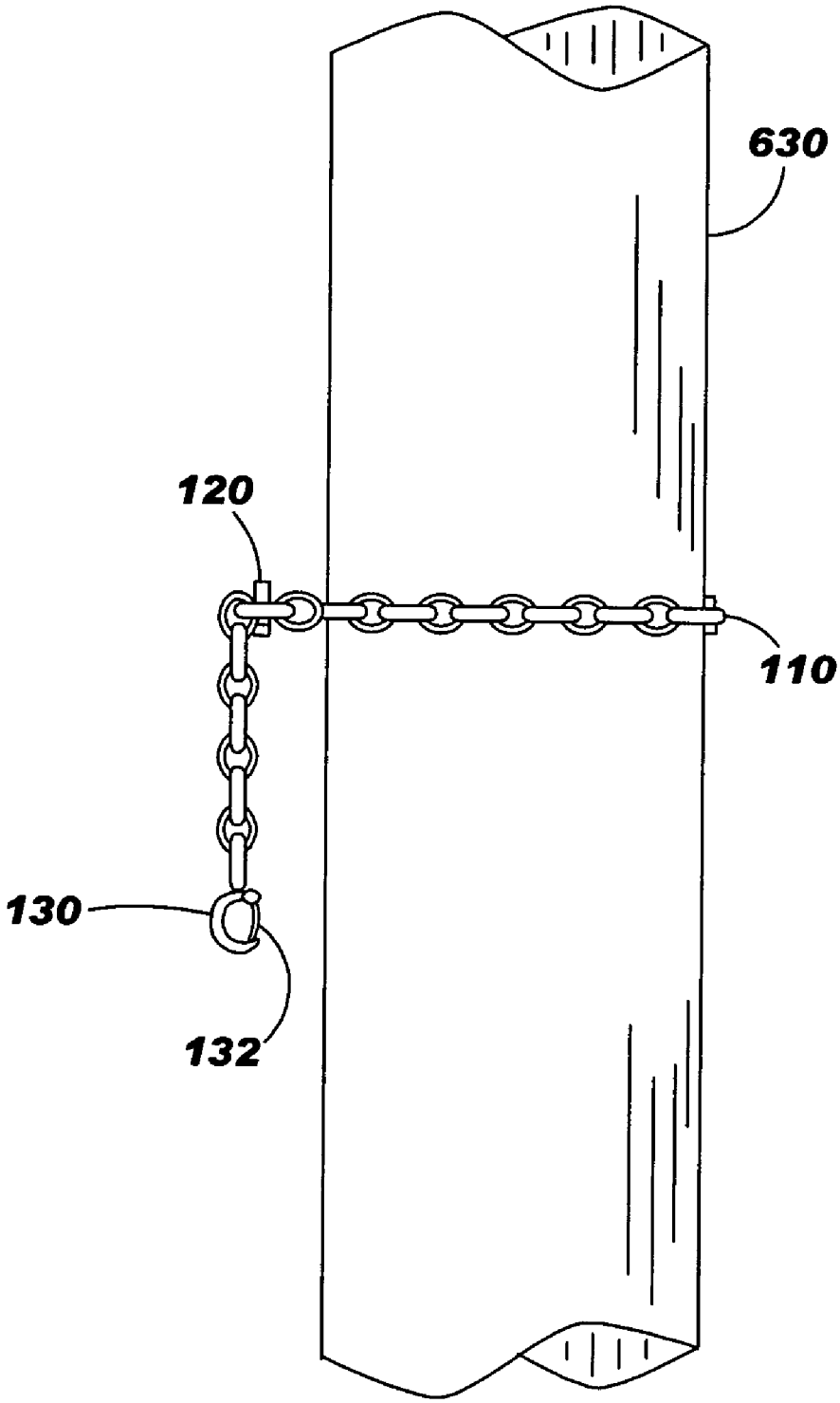
FIG. 8 illustrates a perspective side view of the climber catcher safety device of FIG. 1 supporting a body belt of a fallen technician according to an embodiment of this invention.

Typically, the climber catcher safety device 100 is used as generally shown in FIGS. 6–8. When performing elevated work, a technician 610 positions the climber catcher safety device 100 above and proximate to a safety strap 620 extending about a pole 630. Examples of elevated work include, but are not limited to installation, maintenance, testing, and/or other types of repair work on suspended equipment, such as terminals, wire pouches, J-hooks, network cable, transformers, and/or other types of hardware and equipment used by the telecommunications and/or electrical industry. In general, the pole 630 may be any type of pole, such as for example, a telephone pole, an electrical pole, a tree trunk, and other vertical, columnar members. In most cases, the pole 630 is tapered, such that a diameter of an upper portion of the pole 630 is less than the diameter of a lower portion of the pole 630.

As shown, the technician 610 wears a body belt 622 secured about the technician's waist. The body belt 622 includes a pair of side locking members, shown as D-rings 624 and a sliding ring 650 encircled about a front portion of the body belt 622. The sliding ring 650 may take on a variety of shapes, such as an "O"-shaped ring, a "D"-shaped ring, and the like, so long as the sliding ring 650 mates between the body belt and the safety device 100. Alternatively, as one of ordinary skill in the art appreciates, the sliding ring 650 may be stationary (not shown). The D-rings 624 or alternate locking members (not shown) engage corresponding attachment members 626 (also shown as D-rings) on the ends of the safety strap 620. The safety strap 620 extends around the pole 630 and connects with the body belt 622 worn by the technician 610. When the D-rings 624 of the body belt 622 are engaged with the attachment members 626 of the safety strap 620, the technician 610 may use the safety strap for climbing as well as supporting the technician 610 in a desired working position on the pole 630. In addition, the technician 610 utilizes gaffs 640 having a bladed portion 642 that are driven into and that penetrate the pole 630 to prevent the feet of the technician 610 from slipping and to assist with climbing. When the technician 610 is in the desired working position to perform elevated work, the weight of the technician 610 is supported by the gaffs 640 and by the safety strap 620 such that the technician may freely use his hands to perform the elevated work.

Once the technician 610 reaches the desired working position on the pole 630, the technician 610 positions the climber catcher safety device 100 above and proximate to the safety strap 620 by wrapping the flexible, elongated body (shown as chained link 110) about the pole 630 and securing the D-ring 120 (or alternate positioning means) such that the safety device 100 frictionally engages the pole 630 such that the safety device 100 maintains a desired position above and proximate to the safety strap 620 as shown in FIG. 6. Thereafter, the technician 610 attaches the second D-ring 130 (or alternate engagement means) to the sliding ring 650 of his body belt 622. FIG. 8 illustrates a perspective side view of the climber catcher safety device 100 supporting the body belt 622 of a fallen technician (not shown). When the technician falls, the portion of the chained link 110 positioned about the pole 630 frictionally engages the pole 630 and the second end 114 with the second D-shaped ring 130 attached to the sliding ring 650 of the body belt 622 is caught. The climber catcher safety device 100 thus supports the weight of the fallen technician and prevents the technician from falling to the ground (or alternate lower surface). The climber catcher safety device 100 helps prevent or reduce resultant injuries that may have been caused by the impact of the fall to the ground.

Figure 9:
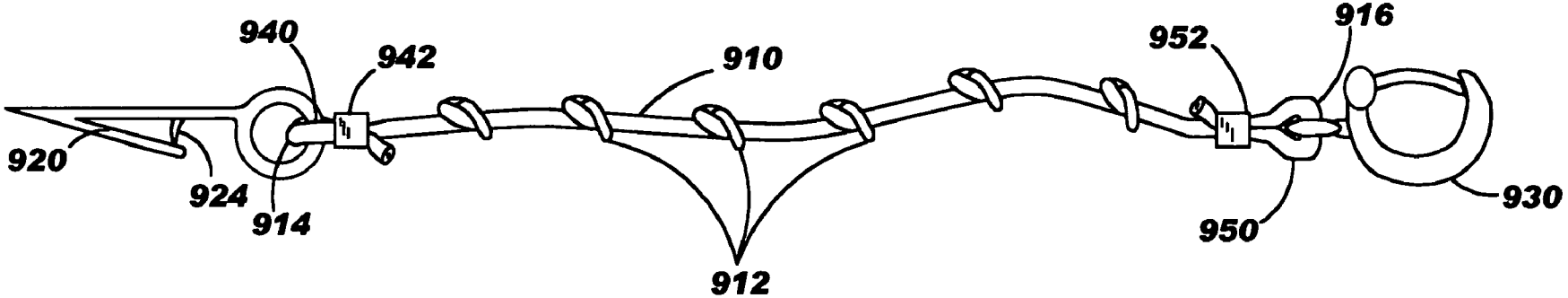
FIG. 9 is a perspective side view of an alternate climber catcher safety device according to an embodiment of this invention.
Figure 11:
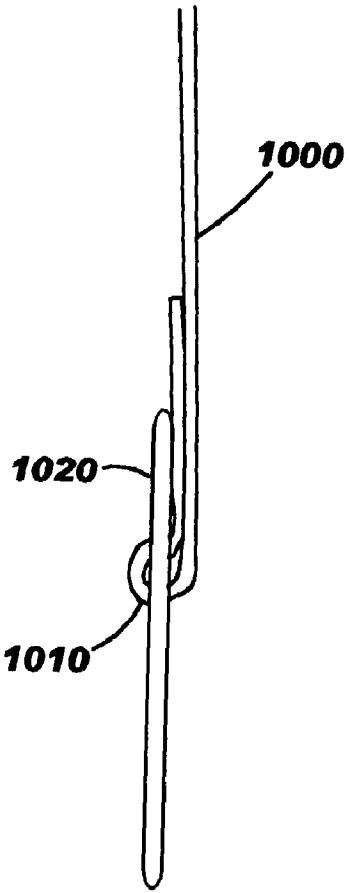
FIG. 11 is a perspective side view of the alternate latching mechanism of FIG. 10.
Figure 10:
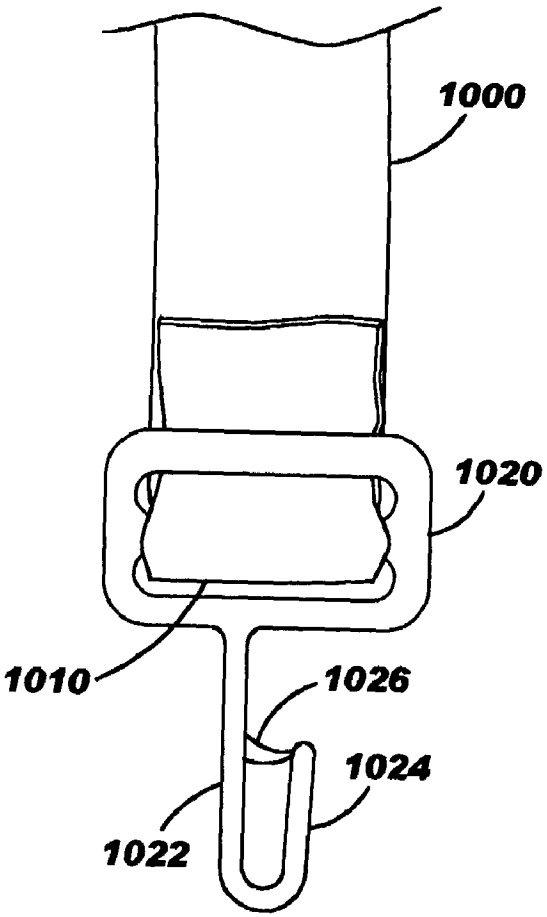
FIG. 10 is a perspective front view of an alternate latching mechanism for the climber catcher safety device.

In addition to the above described embodiments, the climber catcher safety device 100 may include a knotted, rope-like body 910 having one or more knots 912 as shown in FIG. 9. A first end 914 includes a first loop 940 about a knot cincher 920 having a hook 924 that fits about one of the knots 912. The loop 940 of the first end 914 is bound by a clamp 942. A second end 916 includes a second loop 950 about a "D"-shaped, locking ring 930 (similar to D-ring 130 shown in FIG. 1), and the loop 950 of the second end 916 is bound by a clamp 952. The rope-like body 910 may have existing knots 912, or alternatively, the technician could tie a knot to a specific location on the rope-like body 910 to more accurately position the safety device 100. As one of ordinary skill in the art appreciates, the positioning means, engagement means, and connections means (e.g., chained link 110 shown in FIG. 1 and rope-like body 910 in FIG. 9) may take on a variety of shapes and dimensions. For example, FIGS. 10–11 show a substantially, flat elongated body 1000 with an end 1010 looped through a slotted portion of a positioning fastener 1020. The fastener 1020 includes a U-shaped end 1022 with a hooking portion 1024 and a spring loaded latch 1026.

Figure 12:
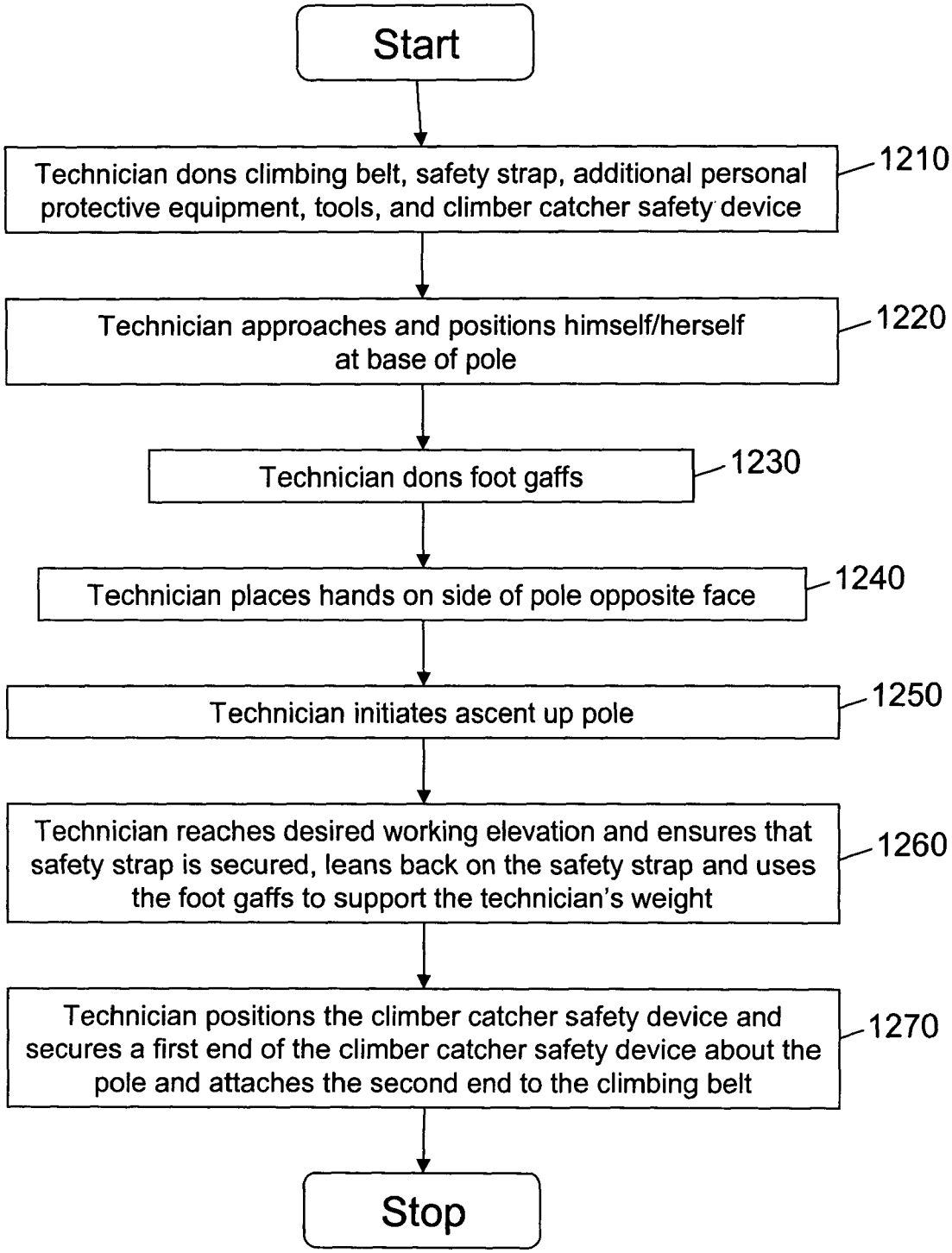
FIG. 12 is a flowchart of a method for using the climber catcher safety device according to an embodiment of this invention.

In addition to the above embodiments, this invention includes a method of positioning the climber catcher safety device and/or a method of supporting or otherwise holding a fallen technician using the climber catcher safety device as herein described. As shown by the flowchart of FIG. 12, the method may include the technician donning a climbing belt and safety strap on the technician's waist as well as putting on additional safety equipment (e.g., hard hat), tools, and the climber catcher safety device [block 1210]. The technician places himself at the base of the pole [block 1220] and dons the foot gaffs [block 1230]. Thereafter, the technician places his/her hands on the side of the pole opposite his/her face [block 1240] and initiates a hand-over-hand ascent up the pole [block 1250]. Once the technician reaches a desired working elevation (e.g., the desired work position), then the technician ensures that the safety strap is secured around the pole and may lean back on the strap and use the secured foot gaffs to support the technician's weight to maintain the position [block 1260]. Thereafter, the technician uses a free hand to position the climber catcher safety device above and proximate to the safety strap by securing a first end of the climber catcher safety device about the pole and attaches the second end of the climber catcher safety device to the climbing belt [block 1270]. If the technician should fall, then the climber catcher safety device catches the technician and supports the weight of the suspended technician from the second end attached to the climbing belt.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A safety device, comprising:

a flexible, elongated body comprising a first end and a second end, the flexible, elongated body for extending about a circumference of a columnar member;

positioning means attached at the first end, the positioning means for positioning and securing a portion of the body about the circumference; and engagement means attached at the second end, the engagement means for engaging a body belt; and wherein the flexible, elongated body comprises one or more chained links and wherein the positioning means comprise a chained link cincher, each link for mating with the chained link cincher of the first end to secure a portion of the body into a desired position about the columnar member.

2. A safety device, comprising:

a flexible, elongated body comprising a first end and a second end, the flexible, elongated body for extending about a circumference of a columnar member;

positioning means attached at the first end, the positioning means for positioning and securing a portion of the body about the circumference; and engagement means attached at the second end, the engagement means for engaging a body belt; and wherein the flexible, elongated body comprises a braided rope body having at least one central hole and wherein the positioning means comprise a hole cincher, the at least one central hole for mating with the hole cincher of the first end to secure a portion of the braided rope body into a desired position about the columnar member.

3. A safety device, comprising:

a flexible, elongated body comprising a first end and a second end, the flexible, elongated body for extending about a circumference of a columnar member;

positioning means attached at the first end, the positioning means for positioning and securing a portion of the body about the circumference; and engagement means attached at the second end, the engagement means for engaging a body belt; and wherein the flexible, elongated body comprises a knotted rope body having at least one knot and wherein the positioning means comprise a knot cincher, the at least one knot for mating with the knot cincher of the first end to secure a portion of the knotted rope body into a desired position about the columnar member.

* * * * *

UNITED STATES PATENT AND TRADEMARK OFFICE

CERTIFICATE OF CORRECTION

PATENT NO. : 6,981,571 B2
APPLICATION NO. : 10/652127
DATED : January 3, 2006
INVENTOR(S) : Frederick James Diggle It is certified that error appears in the above-identified patent and that said Letters Patent is hereby corrected as shown below:

On the title page, add items

(73) Assignee: BellSouth Intellectual Property Corporation, Wilmington, DE (US)

(74) Attorney, Agent, or Firm --Bambi Faivre Walters, Walters & Zimmerman

Signed and Sealed this

Sixth Day of March, 2007

JON W. DUDAS
*Director of the United States Patent and Trademark Office*